US009637282B2

(12) United States Patent
Sakimura et al.

(10) Patent No.: US 9,637,282 B2
(45) Date of Patent: May 2, 2017

(54) CAP

(71) Applicant: TOKYO LIGHT INDUSTRY CO., LTD., Tokyo (JP)

(72) Inventors: Takaaki Sakimura, Nakano-ku (JP); Masashi Sasaki, Sagamihara (JP); Masashi Mizuochi, Sagamihara (JP); Hajime Sasaki, Atsugi (JP); Satoshi Ichikawa, Sagamihara (JP)

(73) Assignee: TOKYO LIGHT INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/408,832

(22) PCT Filed: Oct. 10, 2014

(86) PCT No.: PCT/JP2014/077229
§ 371 (c)(1),
(2) Date: Dec. 17, 2014

(87) PCT Pub. No.: WO2015/173979
PCT Pub. Date: Nov. 19, 2015

(65) Prior Publication Data

US 2015/0353245 A1 Dec. 10, 2015

(30) Foreign Application Priority Data

May 14, 2014 (JP) ..... 2014-100673
Aug. 5, 2014 (JP) ..... 2014-159552

(51) Int. Cl.
*B65D 47/20* (2006.01)
*B65D 47/08* (2006.01)

(52) U.S. Cl.
CPC ..... *B65D 47/20* (2013.01); *B65D 47/0838* (2013.01); *B65D 47/2081* (2013.01)

(58) Field of Classification Search
CPC B65D 47/2081; B65D 47/20; B65D 47/2056; B65D 47/2018; B65D 47/2075; B65D 47/0838
(Continued)

(56) References Cited

U.S. PATENT DOCUMENTS 4,350,179 A * 9/1982 Bunn ..... F04B 39/1053 137/246.12
5,275,312 A * 1/1994 Labruzzo ..... B05B 11/0064 137/540
(Continued)

FOREIGN PATENT DOCUMENTS

JP U-54-136158 9/1979
JP A-2013-241197 12/2013

*Primary Examiner* — Mark A Laurenzi
*Assistant Examiner* — Robert Nichols, II
(74) *Attorney, Agent, or Firm* — Oliff PLC

(57) ABSTRACT

A cap body of a cap includes: a cylindrical inner wall section to be fitted into an inner wall surface of a container mouth section; an annular wall section that extends obliquely in an upper direction toward a radial-direction center integrally from an inner wall surface of the cylindrical inner wall section, has a lower wall surface of a truncated conical shape, and has a discharge hole in a radial-direction center portion; a check valve disposed above the annular wall section to open or close the discharge hole in such a manner that a valve section is detached from or seated on an annular valve seat around the discharge hole; and a guiding tubular body disposed above the check valve and having a discharge passage of contents from the discharge hole. Therefore, at the time of using the contents, the contents can be smoothly discharged to the outside.

5 Claims, 10 Drawing Sheets

(58) Field of Classification Search
USPC ..... 222/491, 482, 494
See application file for complete search history.

(56) References Cited

U.S. PATENT DOCUMENTS

| | | | | |
|---|---|---|---|---|
| 7,059,501 | B2 * | 6/2006 | Masuda | B65D 35/14 222/212 |
| 2004/0112920 | A1 * | 6/2004 | Felten | B65D 47/2081 222/212 |
| 2014/0263443 | A1 * | 9/2014 | Furusawa | B65D 83/0055 222/105 |

* cited by examiner

CAP

TECHNICAL FIELD

The present invention relates to a cap made of a synthetic resin, and more particularly, to a cap that is mounted on a container mouth section of a container filled with liquid contents such as a soy sauce or flowable contents having viscosity and is opened or closed by a pressure inside the container.

BACKGROUND ART

If the fastening of the cap is weak after the use of the above-described contents, there occurs a problem that the sealed state of the container is not maintained and air or fungi are entered into the container. This causes oxidation of the contents or propagation of mold and accelerates deterioration. In order to solve this, a cap to be mounted on a container mouth section is provided in which an internal pressure is applied to the container by squeezing a body section of the container, and immediately after an appropriate amount of the contents is used, a user seals the container (mouth section of the container) without operating the cap by hand.

For example, Patent Literature 1 discloses a valve device in which a coil spring (generally made of metal) is provided together with a valve body opening or closing a liquid outlet hole in the valve device to be fitted into a container mouth of a container, the container is pressed by squeezing a body section of the container, such that a pressure hole/liquid outlet hole is opened by moving the valve body upward, and after use, the pressure hole/liquid outlet hole is closed by moving the valve body downward by a biasing force of the spring.

Also, Patent Literature 2 discloses that a cap body to be fitted into a container mouth section includes a discharge passage that communicates with the container mouth section, a base section that is fitted into the discharge passage and has a discharge hole, and a check valve that is disposed on the base section and allows only the discharge of the contents from the discharge hole. The check valve includes a cylindrical section fitted into the discharge passage, a plurality of elastic pieces extending radially toward the center such that a gap is formed from an inner wall surface of the cylindrical section, and a valve member integrally connected to a front end of each elastic piece and disposed at a downstream side in a discharging direction of the discharge hole to open or close the discharge hole. When the internal pressure of the container is released, each elastic piece of the check valve is restored. Therefore, the valve member closes the discharge hole and the sealed state of the container is maintained.

CITATION LIST

Patent Literature

Patent Literature 1: JP 54-136158 Y
Patent Literature 2: JP 2013-241197 A

SUMMARY OF INVENTION

Technical Problem

However, in the invention of Patent Literature 1, the pressurization hole/liquid outlet hole is provided substantially in the center of the base end section forming the valve chamber. Therefore, in particular, in the case of the flowable contents that are relatively viscous, even when the valve body is moved upward by the internal pressure applied by pressing the body section of the container, the contents may not be smoothly discharged along the pressurization hole/liquid outlet hole. Also, in the invention of Patent Literature 1, since the internal pressure of the container acts on only a part of the valve body through the pressurization hole/liquid outlet hole, it is considered that the valve body cannot be smoothly moved upward.

Also, in the invention of Patent Literature 2, the check valve is operated after the contents are discharged. Therefore, the contents that are not discharged from the discharge passage remain in the discharge passage without being returned to the container. When the lid is closed, the contents may be scattered by the cylindrical closure section of the lid. Furthermore, when the lid is closed and opened again, the contents may be adhered to the cylindrical closure section of the lid. Therefore, improvement is needed.

The present invention has been made in view of such circumstances and is directed to provide a cap that can smoothly discharge the contents to the outside when the contents are used, can maintain the container in the sealed state after use, and can maintain the container in the sealed state while returning the undischarged contents to the container without operations by a user's hand.

Solution to Problem

As a means for solving the above problem, the invention described in some embodiments is a cap, which includes a cap body to be fitted into a container mouth section and is made of a synthetic resin, wherein the cap body includes: a cylindrical wall section to be fitted into an inner wall surface of the container mouth section; an annular wall section that extends obliquely in an upper direction toward a radial-direction center integrally from an inner wall surface of the cylindrical wall section, has a lower wall surface of a truncated conical shape, and has a discharge hole in a radial-direction center portion; a check valve disposed above the annular wall section to open or close the discharge hole in such a manner that a valve section is detached from or seated on an annular valve seat around the discharge hole; and a guiding tubular body disposed above the check valve and having a discharge passage of contents from the discharge hole.

In some embodiments, if the internal pressure is applied to the container by squeezing the body section of the container at the time of using the contents, the check valve is elastically deformed by the internal pressure of the container. The valve section is detached from the annular valve seat around the discharge hole of the annular wall section, and the contents are collected in the discharge hole along the truncated-conical lower wall surface of the annular wall section. Therefore, an appropriate amount of the contents can be smoothly discharged from the discharge hole to the outside. On the other hand, when the internal pressure to the container is released, the check valve is restored and the valve section is seated on the annular valve seat around the discharge hole of the annular wall section. Therefore, since the discharge hole of the annular wall section is closed, it is possible to quickly maintain the container in the sealed state and it is possible to prevent air from flowing into the container. In particular, in the invention of some embodiments, the annular wall section of the cap body extends obliquely in an upward direction toward the radial-direction center integrally from the inner wall surface of the cylindrical wall section and has the truncated-conical lower wall surface. Therefore, at the time of use, the contents can easily flow in a direction of the discharge hole along the truncated-conical lower wall surface of the annular wall section. This configuration requirement is particularly effective to the case where the contents inside the container are flowable contents that are relatively viscous.

In some embodiments, the cap body is configured by incorporating the check valve into a space of which an upper side constituted by the cylindrical wall section and the annular wall section is opened and incorporating the guiding tubular body on the check valve from the upper side.

In some embodiments, when the cap body is assembled, the check valve is incorporated from above on the annular wall section, and the guiding tubular body is incorporated from above on the check valve. Therefore, the workability of the assembling operation can be improved. That is, at the time of assembling, the operation of reversing the structural member up and down is not needed, and the positioning of the structural member need not be performed a plurality of number of times. Therefore, the assembling accuracy is improved and the work management is very simple.

In some embodiments, the check valve includes: a cylindrical support section that abuts against the inner wall surface of the cylindrical wall section; a plurality of elastic pieces that extends toward a radial-direction center integrally from an inner wall surface of the cylindrical support section and having a downward biasing force; the valve section integrally provided in front ends of the respective elastic pieces to open or close the discharge hole; and circulation holes disposed between the respective elastic pieces such that the contents from the discharge hole are circulated therethrough, and wherein an outer peripheral portion of the valve section is pressed against the annular valve seat by the biasing force of the respective elastic pieces.

In some embodiments, the whole check valve can be supported on the annular wall section by the cylindrical support section, and the valve section can be pressed against the annular valve seat around the discharge hole by the respective elastic pieces. Therefore, the whole check valve can be configured to be compact.

In some embodiments, the check valve includes: a cylindrical support section that abuts against the inner wall surface of the cylindrical wall section; an annular elastic section that extends toward a radial-direction center integrally from an entire circumferential-direction region of the inner wall surface of the cylindrical support section and having a downward biasing force; the valve section integrally provided in a radial-direction center portion of the annular elastic section to open or close the discharge hole; and a circulation hole disposed in the annular elastic section such that the contents from the discharge hole are circulated therethrough, and wherein an outer peripheral portion of the valve section is pressed against the annular valve seat by the biasing force of the annular elastic section.

In some embodiments, the whole check valve can be supported on the annular wall section by the cylindrical support section, and the valve section can be pressed against the annular valve seat around the discharge hole by the annular elastic section. Therefore, the whole check valve can be configured to be compact.

In some embodiments, a lower wall surface of the annular wall section and a lower wall surface of the valve section are continuous.

In some embodiments, the entire lower wall surface of the valve section faces the inside of the container mouth section. When the internal pressure is applied to the container by squeezing the body section of the container, the internal pressure can act on the entire lower wall region of the valve section of the check valve. The valve section can be smoothly detached from the annular valve seat around the discharge hole of the annular wall section.

In some embodiments, is a cap, which includes a cap body to be fitted into a container mouth section and is made of a synthetic resin, wherein the cap body includes: a discharge hole that communicates with the container mouth section; an annular valve seat provided around the discharge hole; and a check valve that opens or closes the discharge hole in such a manner that the valve section is detached from or seated on the annular valve seat, and wherein the annular valve seat and the valve section abut against mutual conical surfaces, and a circulation groove is formed between the annular valve seat and the valve section in a radial direction.

In some embodiments, a synthetic resin forming the check valve has a higher elasticity than a synthetic resin forming the annular valve seat.

In some embodiments, if the internal pressure is applied to the container by squeezing the body section of the container at the time of using the contents, the check valve is elastically deformed by the internal pressure of the container. The valve section is detached from the annular valve seat of the annular wall section, and the contents are discharged from the discharge hole to the outside. On the other hand, when the internal pressure to the container is released, the check valve is restored and the valve section is seated on the annular valve seat of the annular wall section through mutual conical surfaces. Therefore, since the discharge hole is closed, it is possible to quickly maintain the container in the sealed state and it is possible to prevent air from flowing into the container. At this time, in the initial stage where the internal pressure to the container is released, the pressing force from the valve section of the check valve to the annular valve seat is low. Therefore, in a state where the circulation groove is opened, the contents that are not discharged to the outside are returned from the circulation groove to the container. After that, since the internal pressing force from the valve section to the annular valve seat is gradually increased, the opening area of the circulation groove is reduced. Due to the surface tension, the contents close the minimum opening of the circulation groove. Therefore, the container can be maintained in the sealed state. Also, since the circulation groove is formed between the valve section and the annular valve seat abutting against the mutual conical surfaces, the contents easily pass through the circulation groove in the initial stage where the internal pressure to the container is released. Therefore, even when the container is held upside down, the contents inside the container are hardly discharged to the outside through the circulation groove if the container itself is not shaken.

In some embodiments, a lid covered on the cap body is connected to the cap body through a hinge, and the circulation groove is formed in one place on a side opposite to the hinge.

In some embodiments, the contents that are not discharged to the outside are easily returned from the circulation groove to the container.

In some embodiments, the circulation groove is formed in the annular valve seat, and the circulation groove is formed to a depth dimension in a range of 0.02 mm to 0.06 mm.

In some embodiments, it is possible to ensure a desired operational effect as the above-described circulation groove.

In some embodiments, the annular valve and the valve section abut against mutual inverted conical surfaces.

In some embodiments, the lower wall surface of the annular wall section and the lower wall surface of the valve section can be made continuous. Furthermore, in the initial stage where the internal pressure to the container is released, the contents easily pass through the circulation groove.

Advantageous Effects of Invention

According to the cap of the present invention, after the use of the contents, the user can quickly restore the container to the sealed state without operating the cap by the hand. Also, the annular wall section of the cap body extends obliquely in an upward direction toward the radial-direction center from the inner wall surface of the cylindrical wall section, and the truncated-conical lower wall surface of the annular wall section and the lower wall surface of the valve section are continuously configured. Therefore, when the internal pressure is applied to the container, the internal pressure acts on the entire lower wall region of the check valve, thereby smoothly moving the valve section upward. Furthermore, since the contents can be easily circulated in a direction of the discharge hole along the truncated-conical lower wall surface of the annular wall section, the contents inside the container can be smoothly discharged to the outside.

Also, according to the cap of the present invention, after the use of the contents, the user can maintain the container in the sealed state while returning the undischarged contents to the container without operations by hand.

DESCRIPTION OF EMBODIMENTS

Hereinafter, embodiments of the present invention will be described in detail with reference to FIGS. 1 to 10(*b*).

First, a cap 1*a* according to a first embodiment of the present invention will be described with reference to FIGS. 1 to 6(*d*).

Figure 1:
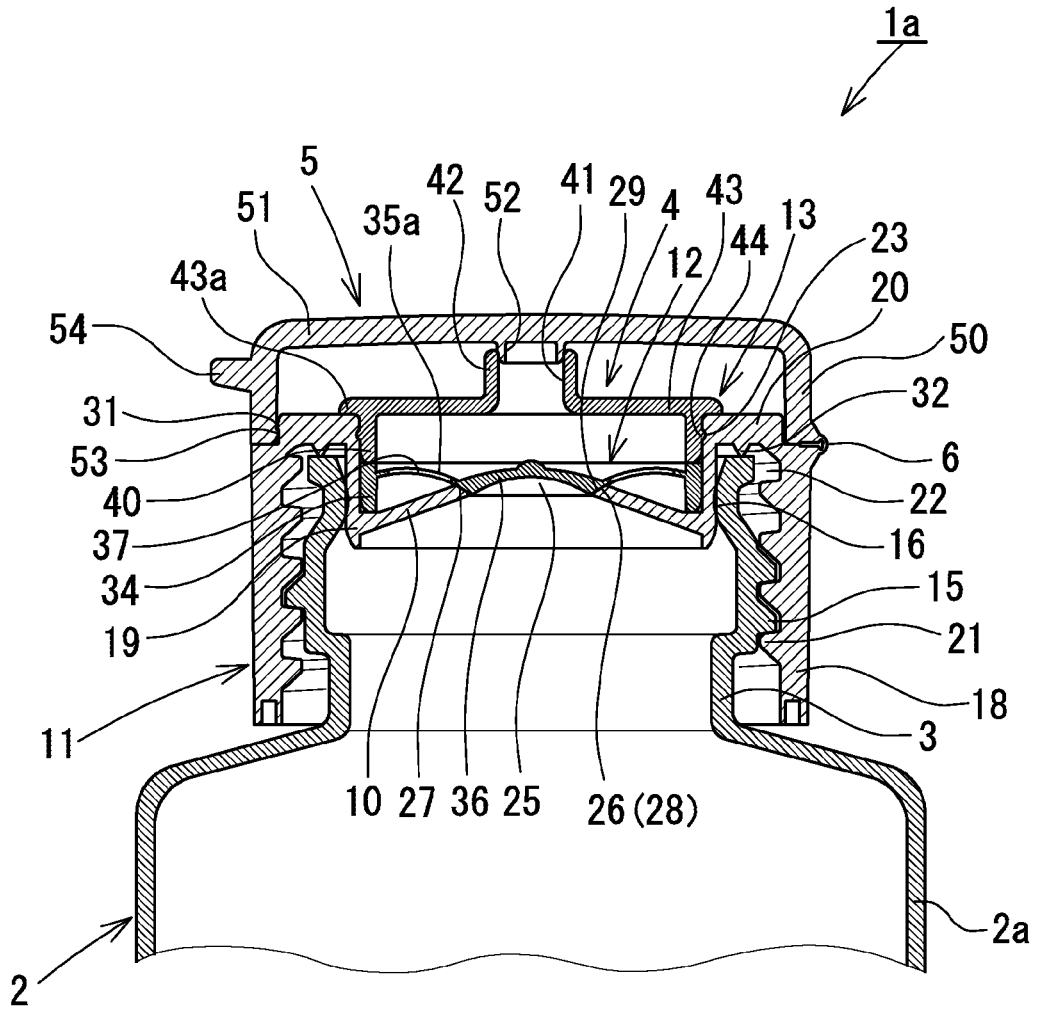
FIG. 1 illustrates a cross-sectional view of a cap according to a first embodiment of the present invention.

As illustrated in FIG. 1, the cap 1*a* according to the first embodiment of the present invention includes a cap body 4 fitted into a container mouth section 3 of a container 2 and having a discharge hole 25 of the contents, and a lid 5 connected through a hinge 6 to a main cap body 11 constituting the cap body 4. The cap 1*a* is configured by assembling three structural members: the main cap body 11 illustrated in FIGS. 2(*a*) and 2(*b*), including an annular wall section 10 to which the lid 5 is connected, a check valve 12 illustrated in FIGS. 4(*a*) to 4(*c*), and a guiding tubular body 13 illustrated in FIGS. 5(*a*) and 5(*b*).

The lid 5 may also be configured as a separate body, without being connected to the cap body 4 by the hinge 6. Furthermore, since a sealed state of the container 2 is maintained by the check valve 12 to be described below, the lid 5 is not necessarily provided as a structural member.

As illustrated in FIG. 1, the container 2 is, for example, an easily deformable container such as a tubular container and is filled with liquid contents or flowable contents having viscosity. Examples of the contents include soy sauce, olive oil, dressing, mayonnaise, ketchup, sauce for pork cutlet, and pasted mustard. The container 2 is a type that discharges the contents by applying an internal pressure, for example, by the way of squeezing a body section 2*a* thereof. The container mouth section 3 is formed to have a cylindrical shape. A male screw section 15 is formed in a lower outer wall surface of the container mouth section 3. A fitting wall section 16, of which a whole peripheral wall portion protrudes inward, is formed in an upper side of the container mouth section 3. Also, the cap 1*a* can be employed in a double container provided with an outer container and an inner container (including a container called a delamination container) and is mounted on the container mouth section 3 of the outer container 2. The inner container is filled with the contents and has a flexibility that is deformed in a deflated manner according to the decrease of the contents. In order to hold the reduced volume shape of the inner container, it is configured such that outside air is suctioned between the outer container and the inner container.

As illustrated in FIG. 1, the cap body 4 includes: the cylindrical main cap body 11 screwed to the container mouth section 3; the annular wall section 10 extending obliquely in an upward direction toward the radial-direction center integrally from the inner wall surface of a cylindrical inner wall section 19 of the main cap body 11 and having the discharge hole 25 in the radial-direction center portion; the check valve 12 disposed above the annular wall section 10 to open or close the discharge hole 25 in such a manner that a valve section 36 is detached from or seated on an annular valve seat 26 around the discharge hole 25; and the guiding tubular body 13 disposed in the upper side of the check valve 12 and having a discharge passage 41 of the contents from the discharge hole 25. A synthetic resin forming the check valve 12 has a higher elasticity than a synthetic resin forming the main cap body 11. Specifically, the main cap body 11 (including the lid 4) and the guiding tubular body 13 are made of polypropylene. Also, the check valve 12 is made of a polyethylene elastomer.

Figure 2A:
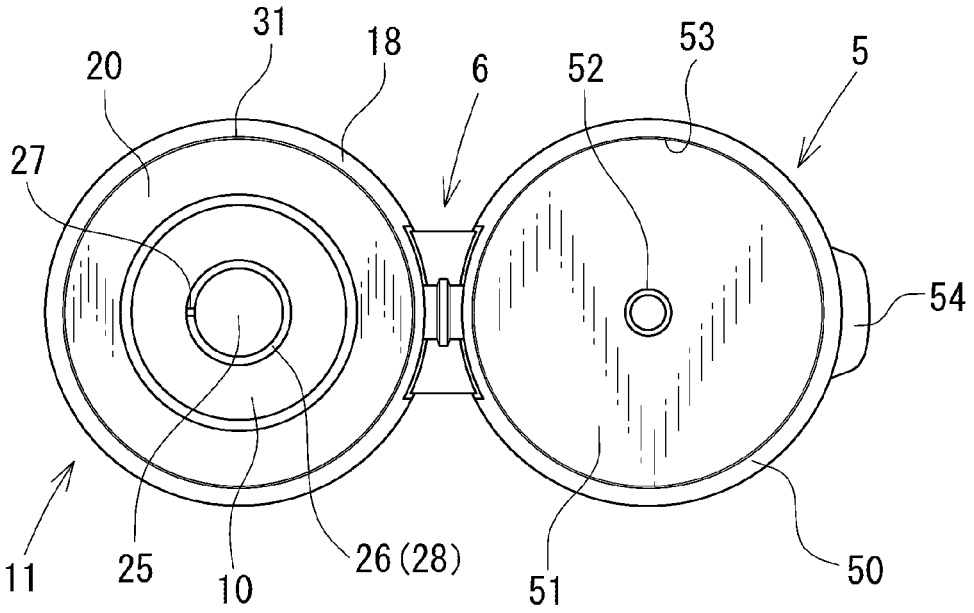
FIG. 2(*a*) illustrates a plan view of a lid and a main cap body including an annular wall section in the configuration of the cap of FIG. 1, and FIG. 2(*b*) illustrates a cross-sectional view of FIG. 2(*a*).
Figure 2B:
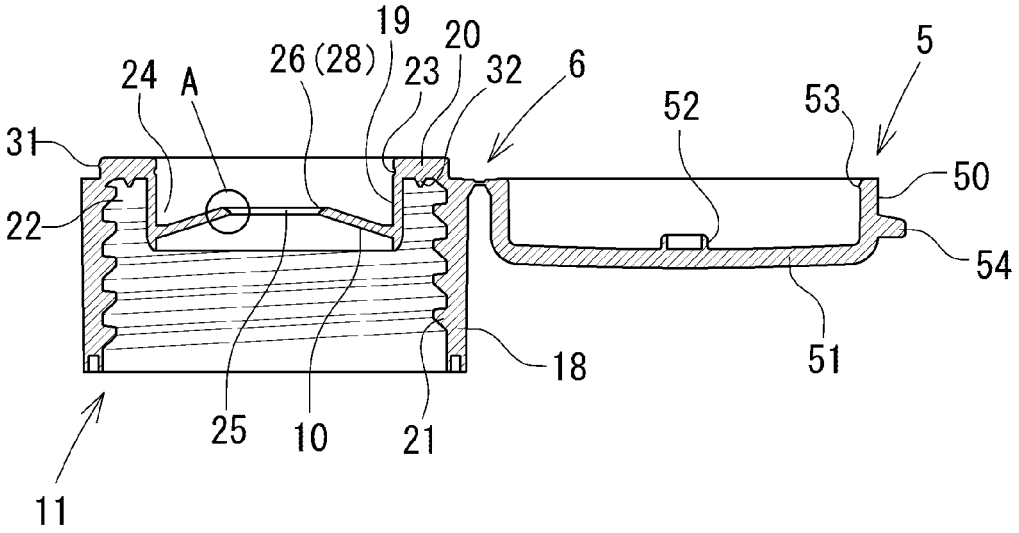
Figure 3A:
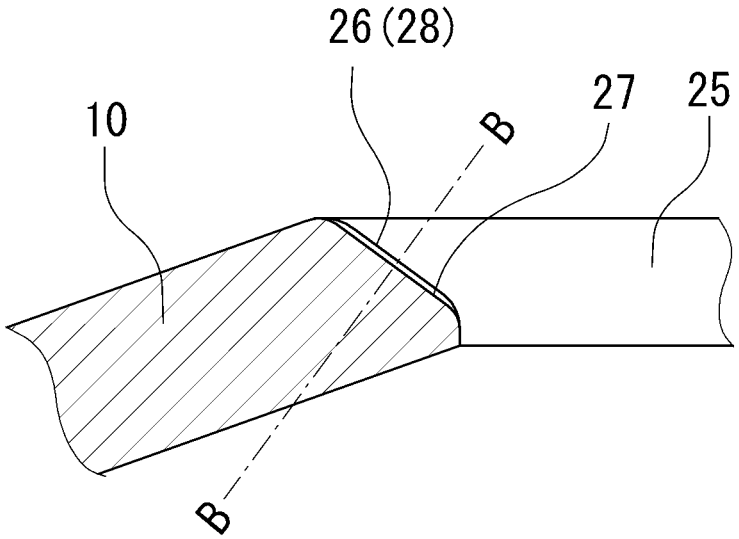
FIG. 3(*a*) illustrates an enlarged view of portion A of FIG. 2(*b*), and FIG. 3(*b*) illustrates a cross-sectional view taken along line B-B of FIG. 3(*a*).
Figure 3B:
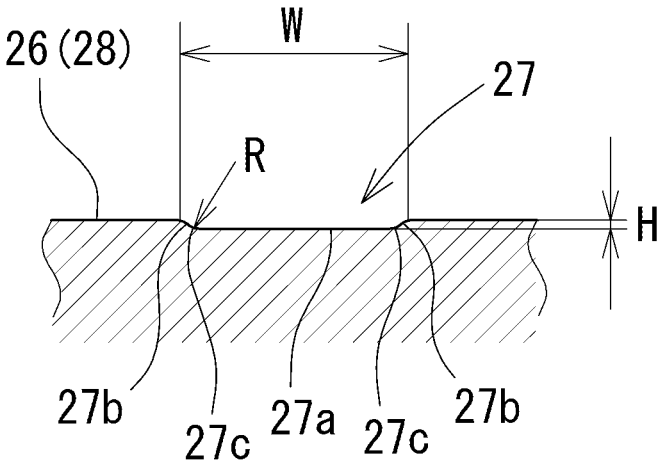

As illustrated in FIGS. 1 to 2(*b*), the main cap body 11 includes: a cylindrical outer wall section 18 screwed to the container mouth section 3; the cylindrical inner wall section 19 concentrically disposed in the inner side of the cylindrical outer wall section 18; and an annular horizontal wall section 20 connecting the upper end of the cylindrical outer wall section 18 and the upper end of the cylindrical inner wall section 19. On the inner wall surface of the cylindrical outer wall section 18, a female screw section 21 screwed to the male screw section 15 provided in the container mouth section 3 is formed in an entire axial-direction region. An annular space 22 is formed between the cylindrical inner wall section 19 and the cylindrical outer wall section 18. An annular fitting concave section 23 extending along a circumferential direction in an annular shape is formed on the upper inner wall surface of the cylindrical inner wall section 19.

On the lower inner wall surface of the cylindrical inner wall section 19, the annular wall section 10 extends obliquely toward the radial-direction center integrally from the entire circumferential-direction region thereof. The lower wall surface of the annular wall section 10 has a truncated conical shape. A space 24, of which an upper side is opened, is formed by the annular wall section 10 and the inner wall surface of the cylindrical inner wall section 19. The substantially circular discharge hole 25 is opened in the radial-direction center portion of the annular wall section 10. The discharge port 25 communicates with the inside of the container mouth section 3. The discharge hole 25 is formed in the range of ϕ5.0 mm to ϕ12.0 mm. The annular valve seat 26 is provided around the discharge hole 25. The annular valve seat 26 is formed on the inverted conical surface 28 (diameter-enlarged annular tapered surface or mortar-shaped conical surface on the upper side).

As illustrated in FIGS. 2(*a*) to 3(*b*), a circulation groove 27 is formed in the annular valve seat 26 (inverted conical surface 28) of the annular wall section 10 in one place along a radial direction. The circulation groove 27 is formed at a position of a side opposite to the hinge 6 side. The circulation groove 27 is formed to have a shallow U-shape of which a cross-section has a predetermined width. Opposite side surfaces 27*b* of the circulation groove 27 are respectively formed in inclined surfaces such that the opposite side surfaces 27*b* are mutually close toward a bottom section 27*a*. The bottom surface 27*a* and the opposite side surface 27*b* of the circulation groove 27 are respectively connected to curved surfaces 27*c*. A width dimension W of the circulation groove 27 is formed in the range of 0.2 mm to 3.0 mm, and preferably, in the range of 0.6 mm to 1.2 mm. A depth dimension H of the circulation groove 27 is formed in the range of 0.02 mm to 0.06 mm. A curvature radius R of the curved surface 27*c* is formed in the range of 0.2 mm to 0.6 mm. The circulation groove 27 may be formed to have a V-shaped cross-section.

As illustrated in FIGS. 1 to 2(*b*), an outer diameter of the annular horizontal wall section 20 is smaller than an outer diameter of the cylindrical outer wall section 18, and a protruding locking section 31 extending annularly along a circumferential direction is formed on the outer wall surface thereof. The lid 5 is fitted into the outer wall surface of the annular horizontal wall section 20. On the lower surface of the annular horizontal wall section 20, an annular sealing section 32 is vertically disposed concentrically with the cylindrical outer wall section 18. A lower end of the annular sealing section 32 is in close contact with an upper end of the container mouth section 3.

Figure 4A:
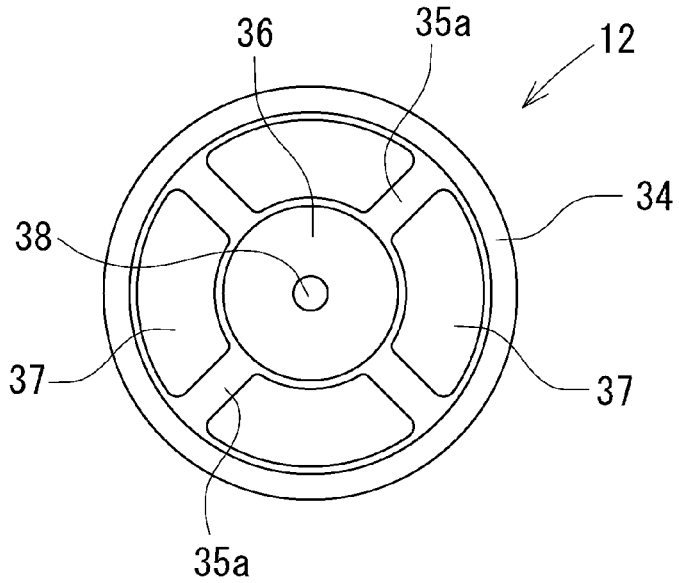
FIG. 4(*a*) illustrates a plan view of a check valve as the configuration of the cap of FIG. 1, FIG. 4(*b*) illustrates a cross-sectional view of FIG. 4(*a*), and FIG. 4(*c*) illustrates a bottom view of FIG. 4(*a*).
Figure 4B:
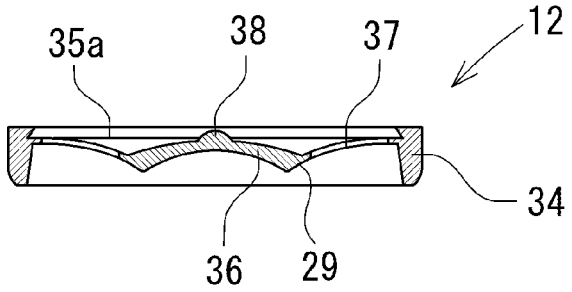
Figure 4C:
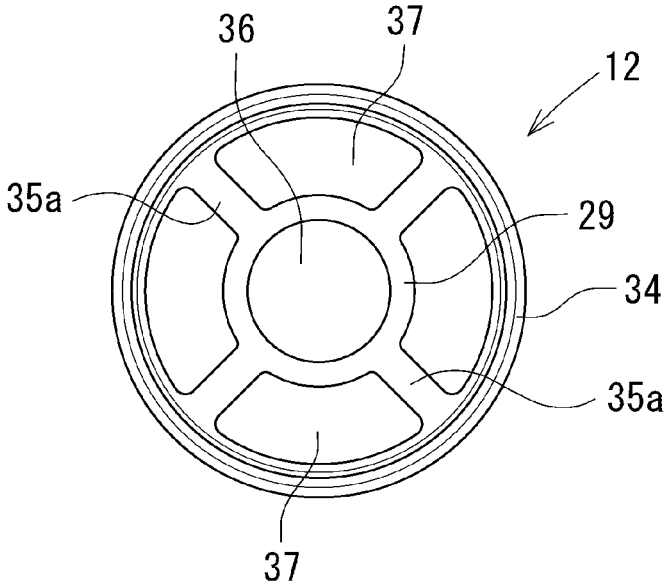

As illustrated in FIGS. 1, 4(*a*), and 4(*b*), the check valve 12 includes: a cylindrical support section 34 abutting against the inner wall surface of the cylindrical inner wall section 19 of the main cap body 11; a plurality of elastic pieces 35*a* extending toward a radial-direction center integrally from the inner wall surface of the cylindrical support section 34 and having a downward biasing force; a valve section 36 integrally connected to front ends of the respective elastic pieces 35*a* to open or close the discharge hole 25; and a plurality of circulation holes 37 disposed between the respective elastic pieces 35*a* such that the contents from the discharge hole 25 are circulated therethrough.

Each of the elastic pieces 35*a* extends to be slightly curved toward the radial-direction center from the upper inner wall surface of the cylindrical support section 34 and in an obliquely downward direction. Each of the elastic pieces 35*a* has a downward biasing force. In the present embodiment, the elastic pieces 35*a* are formed in four places at 90° pitches in a circumferential direction, and the circulation holes 37 are formed in four places between the respective elastic pieces 35*a* at 90° pitches. Each of the respective elastic pieces 35*a* extends toward the radial-direction center in a rectangular cross-sectional shape with the same thickness and the same width. The width dimensions of the elastic pieces 35*a* disposed in the four places are all substantially equal to one another. The thickness dimensions of the respective elastic pieces 35*a* are all substantially equal to one another. The front ends of the respective elastic pieces 35*a* are integrally connected to the upper edges of the outer peripheral portion of the valve section 36. The valve section 36 has a dome shape. Specifically, the valve section 36 has a circular plan-view shape and is configured by a curved wall section with an upwardly convex shape. Also, the outer peripheral portion of the valve section 36 is formed on the inverted conical surface 29 (diameter-enlarged annular tapered surface or mortar-shaped conical surface on the upper side) so as to be seated on the annular valve seat 26 (inverted conical surface 28). A spherical convex section 38 protrudes on the valve section 36.

Figure 5A:
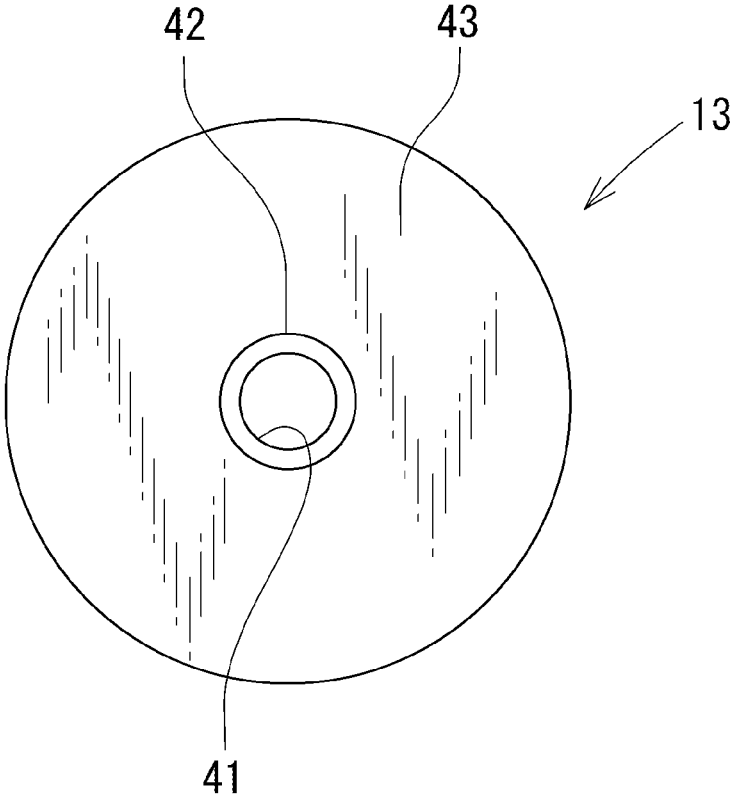
FIG. 5(*a*) illustrates a plan view of a guiding tubular body as the configuration of the cap of FIG. 1, and FIG. 5(*b*) illustrates a cross-sectional view of FIG. 5(*a*).
Figure 5B:
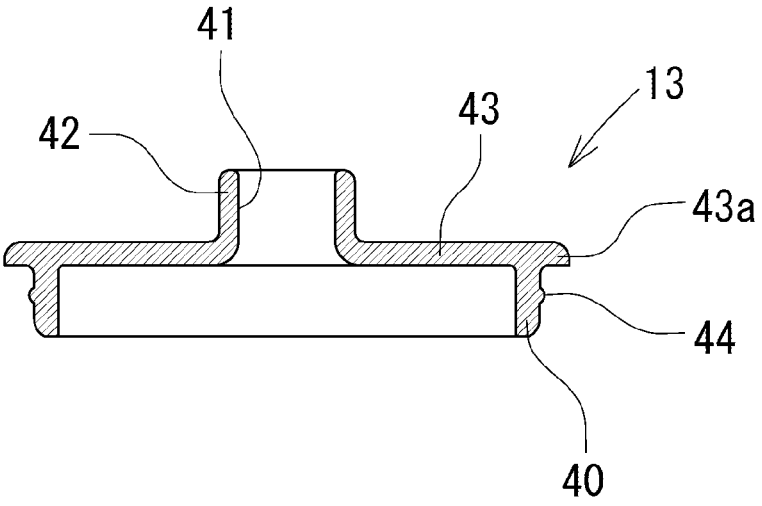
Figure 6A:
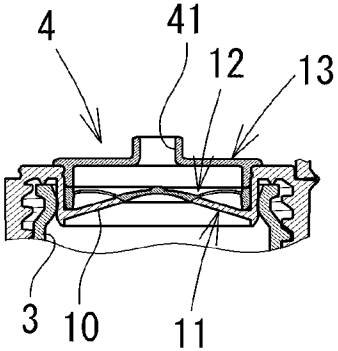
FIGS. 6(*a*) to 6(*d*) illustrate diagrams of the operation of the cap of FIG. 1 stepwise.
Figure 6B:
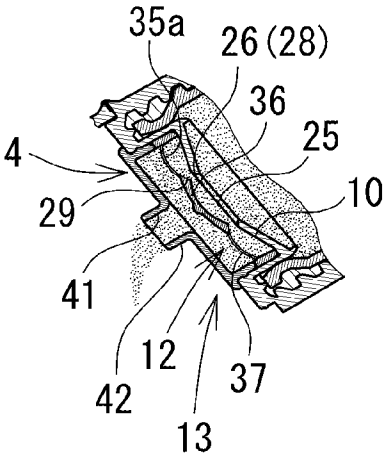
Figure 6C:
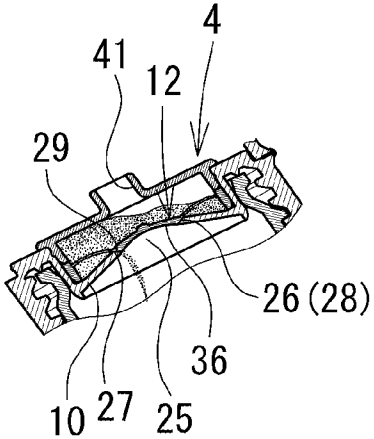
Figure 6D:
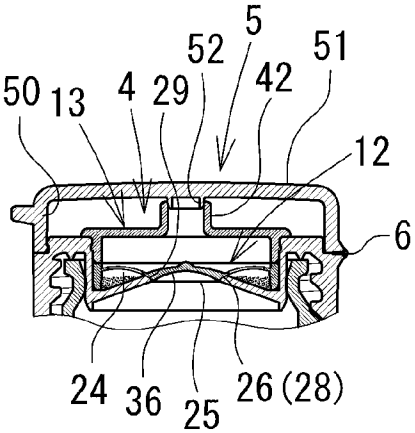

As illustrated in FIGS. 1, 5(*a*), and 5(*b*), the guiding tubular body 13 is disposed above the check valve 12. The guiding tubular body 13 includes: a cylindrical support section 40 fitted into the cylindrical inner wall section 19 of the main cap body 11; a cylindrical guide section 42 disposed concentrically in the inner side of the cylindrical support section 40 and having a discharge passage 41 thereinside; and an annular horizontal wall section 43 integrally connecting the upper end of the cylindrical support section 40 and the lower end of the cylindrical guide section 42. An annular flange section 43*a* protruding on the radial-directed outer side than the outer peripheral surface of the cylindrical support section 40 is formed in the annular horizontal wall section 43. The cylindrical support section 40 is disposed above the cylindrical support section 34 constituting the check valve 12. An annular protrusion section 44 extending in a circumferential direction is formed on the outer wall surface of the cylindrical support section 40. The thickness of the peripheral wall portion of the cylindrical support section 40 is substantially equal to the thickness of the peripheral wall portion of the cylindrical support section 34 of the check valve 12.

As illustrated in FIGS. 1 to 2(*b*), the lid 5 is integrally connected to the cylindrical outer wall section 18 of the main cap body 11 through the hinge 6. The lid 5 includes a cylindrical body section 50 connected through the hinge 6 to the outer wall surface of the cylindrical outer wall section 18 of the main cap body 11, and a top surface section 51 integrally connected to an entire circumferential-direction region of an upper end of the body section 50. A cylindrical close contact section 52 is vertically disposed in the radial-direction center portion of the top surface section 51. The cylindrical close contact section 52 is closely fitted into the upper end inner portion of the cylindrical guide section 42 of the guiding tubular body 13 constituting the cap body 4.

A protruding locking section 53 extending along a circumferential direction in an annular shape is formed on the lower inner wall surface of the body section 50. In a side opposite to the hinge 6 side on the upper outer wall surface of the body section 50, a grip section 54 that is gripped by a user protrudes outward in a predetermined range along a circumferential direction.

Next, a method of assembling and mounting the cap 1*a* on the container mouth section 3 according to the first embodiment of the present invention will be described.

First, the check valve 12 is incorporated from above on the upper surface of the annular wall section 10 of the main cap body 11. Specifically, the check valve 12 is disposed on the upper surface of the annular wall section 10 such that the outer wall surface of the cylindrical support section 34 of the check valve 12 is disposed along the inner wall surface of the cylindrical inner wall section 19 of the main cap body 11. That is, the check valve 12 is incorporated into the space 24 of which the upper side surrounded by the annular wall section 10 and the inner wall surface of the cylindrical inner wall section 19 from above is opened.

Subsequently, the guiding tubular body 13 is incorporated into the upper side of the check valve 12 by pressing, such that the outer wall surface of the cylindrical support section 40 is disposed along the inner wall surface of the cylindrical inner wall section 19 of the main cap body 11. The annular protrusion section 44 provided on the outer wall surface of the cylindrical support section 40 of the guiding tubular body 13 is fitted into the annular fitting concave section 23 provided on the inner wall surface of the cylindrical inner wall section 19 of the main cap body 11. The annular flange section 43*a* of the guiding tubular body 13 is assembled to abut against the upper surface of the annular horizontal wall section 20. As a result, the inverted conical surface 29 provided in the outer peripheral portion of the valve section 36 of the check valve 12 is in close contact with the annular valve seat 26 (inverted conical surface 28) around the discharge hole 25 of the annular wall section 10, and the lower wall surface of the valve section 36 and the lower wall surface of the annular wall section 10 are continued to flush with each other. The entire lower wall surface of the valve section 36 faces the inside of the container mouth section 3. Also, since the lower end (outer peripheral portion) of the valve section 36 of the check valve 12 is located at the upper side than the position prior to the incorporation, the inverted conical surface 29 of the valve section 36 of the check valve 12 is closely contacted and pressed against the annular valve seat 26 (inverted conical surface 28) around the discharge hole 25 of the annular wall section 10 by the downward biasing force (restoring force) of the respective curved elastic pieces 35*a*. Also, the cylindrical guide section 42 of the guiding tubular body 13 is disposed directly above the valve section 36 (discharge hole 25) of the check valve 12. In this way, the assembling of the cap body 4 is completed.

Subsequently, when the lid 5 is covered on the cap body 4, the hinge 6 is bent to cover the lid 5 from above the cap body 4. Then, the protruding locking section 53 provided in the body section 50 of the lid 5 is engaged to climb over the protruding locking section 31 provided in the annular horizontal wall section 20 of the cap body 4. The cylindrical close contact section 52 provided in the top surface section 51 of the lid 5 is tightly fitted into the upper end inner portion of the cylindrical guide section 42 constituting the guiding tubular body 13 of the cap body 4.

Subsequently, when the cap body 4 is mounted on the container mouth section 3, the male screw section 15 provided on the outer wall surface of the container mouth section 3 and the female screw section 21 provided on the inner wall surface of the cylindrical outer wall section 18 of the cap body 4 are screwed to each other by inserting the peripheral wall portion of the container mouth section 3 into the annular space 22 between the cylindrical inner wall section 19 and the cylindrical outer wall section 18 of the cap body 4. In this way, the outer wall surface of the cylindrical inner wall section 19 of the main cap body 11 is crimped by the fitting wall section 16 of the container mouth section 3, and the lower end of the annular sealing section 32 vertically provided from the lower surface of the annular horizontal wall section 20 of the main cap body 11 comes into close contact with the upper end of the container mouth section 3. In this way, the mounting of the cap 1*a* on the container mouth section 3 is completed. In the present embodiment, the method of mounting the cap 1*a* on the container mouth section 3 by screwing has been described, but the cap 1*a* may also be mounted by another mounting method, for example, a capping method.

Next, the operation of the cap 1*a* according to the first embodiment of the present invention will be described.

When the contents are used, first, as illustrated in FIG. 6(*a*), the lid 5 is opened to expose the guiding tubular body 13 of the cap body 4 to the outside.

Subsequently, as illustrated in FIG. 6(*b*), the user applies the internal pressure to the container 2 by squeezing the body section 2*a* of the container 2 in a state in which the container 2 is tilted in a discharge posture such that the discharge passage 41 of the guiding tubular body 13 is directed downward. In this way, the internal pressure of the container 2 acts on the entire lower wall surface of the valve section 36 of the check valve 12, and the respective elastic pieces 35*a* of the check valve 12 are bent by elastic deformation. The inverted conical surface 29 of the outer peripheral portion of the valve section 36 is detached from the annular valve seat 26 (inverted conical surface 28) around the discharge hole 25 of the annular wall section 10. As a result, the discharge hole 25 of the annular wall section 10 is opened, and an appropriate amount of the contents is collected from the container mouth section 3 to the discharge hole 25 along the truncated-conical lower wall surface of the annular wall section 10. The contents are discharged from the discharge hole 25 to the outside through the respective circulation holes 37 of the check valve 12 and the discharge passage 41 of the cylindrical guide section 42 of the guiding tubular body 13.

Then, after an appropriate amount of the contents is discharged, the squeezing of the body section 2*a* of the container 2 is stopped. As illustrated in FIG. 6(*c*), when trying to return the container 2 to an erected posture, the internal pressure to the container 2 is released. Therefore, the respective elastic pieces 35*a* of the check valve 12 are restored, and the inverted conical surface 29 of the outer peripheral portion of the valve section 36 is seated on the annular valve seat 26 (inverted conical surface 28) around the discharge hole 25 of the annular wall section 10. The discharge hole 25 of the annular wall section 10 is closed by the valve section 36. At this time, in the initial stage where the internal pressure to the container 2 is released, the pressing force from the valve section 36 of the check valve 12 to the annular valve seat 26 is low. Therefore, in a state where the circulation groove 27 is opened, the contents that are not discharged from the discharge passage 41 of the guiding tubular body 13 to the outside (contents between the guiding tubular body 13, and the check valve 12 and the annular wall section 10) are returned from the circulation groove 27 to the container 2. As illustrated in FIG. 6(*d*), after that, the pressing force from the valve section 26 to the annular valve seat 26 is gradually increased and the valve section 36 has elasticity. Therefore, the opening area of the circulation groove 27 is reduced. Finally, since the contents close the minimum opening of the circulation groove 27 by the surface tension, the inside of the container 2 can be maintained in the sealed state. In this way, immediately after use, the user can quickly seal the container 2 and suppress air from flowing into the container 2 while returning the undischarged contents inside the cap body 4 to the container 2, without operating the cap 1*a* by hand.

Subsequently, as illustrated in FIGS. 1 and 6(*d*), if the hinge 6 is bent to cover the lid 5 from above the cap body 4, the protruding locking section 53 provided in the body section 50 of the lid 5 is engaged to climb over the protruding locking section 31 provided in the annular horizontal wall section 20 of the cap body 4. The cylindrical close contact section 52 provided in the top surface section 51 of the lid 5 is tightly fitted into the upper end inner portion of the cylindrical guide section 42 constituting the guiding tubular body 13 of the cap body 4. At this time, the remaining surface of the contents of the discharge passage 41 of the guiding tubular body 13 (the inside of the cylindrical guide section 42) can be lowered by returning the remaining undischarged contents to the inside of the container 2. Therefore, by covering the lid 5 on the cap body 4, it is possible to prevent the contents from being scattered when the cylindrical close contact section 52 of the lid 5 is fitted into the cylindrical guide section 42 and it is also possible to prevent the contents from being adhered to the cylindrical close contact section 52 of the lid 5. By covering the lid 5 on the cap body 4, it is possible to prevent foreign substances from being introduced into the cap body 4 (between the guiding tubular body 13, and the check valve 12 and the annular wall section 10), and it is possible to doubly seal the container 2. Furthermore, since the inside of the cap body 4 is sealed by the lid 5, the contents are not oxidized even when the contents remain slightly in the space 24 on the annular wall section 10.

As described above, in the cap 1*a* according to the first embodiment of the present invention, in particular, the cap body 4 includes: the main cap body 11 having the cylindrical inner wall section 19 fitted into the inner wall surface of the container mouth section 3; the annular wall section 10 extending obliquely in an upward direction toward the radial-direction center integrally from the inner wall surface of the cylindrical inner wall section 19 and having the truncated-conical lower wall surface and the discharge hole 25 in the radial-direction center portion; the check valve 12 disposed above the annular wall section 10 to open or close the discharge hole 25 in such a manner that the inverted conical surface 29 disposed in the outer peripheral portion of the valve section 36 is detached from or seated on the annular valve seat 26 (inverted conical surface 28) around the discharge hole 25; and the guiding tubular body 13 disposed above the check valve 12 and having the discharge passage 41 of the contents from the discharge hole 25. In this way, if the internal pressure is applied to the container 2 by squeezing the body section 2*a* of the container 2 at the time of using the contents, the check valve 12 is elastically deformed by the internal pressure of the container 2. The inverted conical surface 29 provided in the outer peripheral portion of the valve section 36 is detached from the annular valve seat 26 (inverted conical surface 28) around the discharge hole 25 of the annular wall section 10, and the discharge hole 25 is opened. Then, an appropriate amount of the contents is discharged from the container mouth section 3 through the discharge hole 25 to the outside. Furthermore, in the cap 1*a*, the annular wall section 10 of the cap body 4 extends obliquely in an upward direction toward the radial-direction center from the inner wall surface of the cylindrical inner wall section 19. Therefore, at the time of use, the contents can easily flow in a direction of the discharge hole 25 along the truncated-conical lower wall surface of the annular wall section 10. At the time of use, the contents can also be smoothly discharged. On the other hand, when the internal pressure to the container 2 is released, the inverted conical surface 29 provided in the outer peripheral portion of the valve section 36 of the check valve 12 is seated on the annular valve seat 26 (inverted conical surface 28) around the discharge hole 25 of the annular wall section 10, and the discharge hole 25 of the annular wall section 10 is closed. Therefore, the user can seal the container 2 and suppress air from flowing into the container 2, without operation by hand.

Also, in the cap 1*a* according to the first embodiment of the present invention, the lid 5 covered on the cap body 4 is provided. In the lid 5, the cylindrical close contact section 52 is formed to be tightly fitted into the upper end inner portion of the guiding tubular body 13 provided in the cap body 4. Therefore, by covering the lid 5 on the cap body 4 after the use of the contents, it is possible to prevent foreign substances from being introduced into the cap body 4 (between the guiding tubular body 13, and the check valve 12 and the annular wall section 10). Since the container 2 is doubly closed, the sealed state of the container 2 can be reliably secured.

Furthermore, in the cap 1*a* according to the first embodiment of the present invention, when the cap body 4 is assembled, the check valve 12 is disposed from above in the space 24 on the annular wall section 10. After that, the guiding tubular body 13 is incorporated from above on the check valve 12. In this way, at the time of assembling the cap body 4, since the operation of reversing the structural member up and down is not needed, the workability of the assembling operation can be improved.

Furthermore, in the cap 1*a* according to the first embodiment of the present invention, the lower wall surface of the valve section 36 formed by the upwardly convex curved wall section and the lower wall surface of the annular wall section 10 are continuously configured. Therefore, when the internal pressure is applied to the container 2, the internal pressure can act on the entire lower wall surface of the valve section 36, and thus, the valve section 36 can be smoothly detached from the annular valve seat 26 around the discharge hole 25 of the annular wall section 10.

Furthermore, in the cap 1*a* according to the first embodiment of the present invention, the cap body 4 includes: the discharge hole 25 extending obliquely in an upper direction toward the radial-direction center and disposed in the radial-direction center portion; the annular wall section 10 having the annular valve seat 26 provided around the discharge hole 25; and the check valve 12 disposed above the annular wall section 10 to open or close the discharge hole 25 in such a manner that the valve section 36 is detached from or seated on the annular valve seat 26. The annular valve seat 26 and the valve section 36 abut against the mutual inverted conical surfaces 28 and 29. The circulation groove 27 is formed between the annular valve seat 26 and the valve section 36 toward the radial direction. Therefore, in particular, in the initial stage where the internal pressure to the container 2 is released, the contents that are not discharged from the discharge passage 14 of the guiding tubular body 13 to the outside are returned from the circulation groove 27 to the container 2. After that, finally, the opening of the circulation groove 27 is minimized by the pressing force (restoring force) of the check valve 12, and the contents close the circulation groove 27 by the surface tension. Therefore, the container 2 can be maintained in the sealed state. Furthermore, the annular valve seat 26 and the valve section 36 are configured to come into close contact with the mutual inverted conical surfaces 28 and 29, and the circulation groove 27 is formed on the inverted conical surface 28 of the annular valve seat 26. Therefore, in the initial stage where the internal pressure to the container 2 is released, the contents easily pass through the circulation groove 27.

Furthermore, in the cap 1*a* according to the first embodiment of the present invention, the circulation groove 27 is formed in one place at a position of the annular valve seat 26 opposite to the hinge 6 side. Therefore, in the initial stage where the internal pressure to the container 2 is released, the contents that are not discharged from the discharge passage 14 to the outside are easily returned from the circulation groove 27 to the container 2.

Furthermore, in the cap 1*a* according to the first embodiment of the present invention, the cap body 4 includes the annular wall section 10 extending obliquely in an upper direction toward the radial-direction center integrally from the inner wall surface of the cylindrical inner wall section 19. Therefore, when the peripheral wall portion of the container mouth section 3 is inserted into the annular space 22 between the cylindrical inner wall section 19 and the cylindrical outer wall section 18 of the cap body 4, the annular wall section 10 acts as a reinforcement member, thereby improving the sealing characteristic between the cylindrical inner wall section 19 and the container mouth section 3. Also, the annular wall section 10 extends obliquely in an upper direction toward the radial-direction center. Therefore, when the peripheral wall portion of the container mouth section 3 is inserted into the annular space 22 between the cylindrical inner wall section 19 and the cylindrical outer wall section 18, the annular wall section 10 can allow the elastic deformation to the inner side of the cylindrical inner wall section 19 as compared to the form that extends in the horizontal direction. Therefore, the peripheral wall section of the container mouth section 3 can be smoothly inserted into the annular space 22, without resistance. On the other hand, after the insertion, the restoring force of the cylindrical inner wall section 19 to the outer side can be increased by the annular wall section 10, thereby improving the sealing characteristic.

In the cap 1*a* according to the first embodiment of the present invention, the circulation groove 27 is formed on the inverted conical surface 28 of the annular valve seat 26 side, but it may be formed on the inverted conical surface 29 of the valve section 36 side.

Also, in the cap 1*a* according to the first embodiment of the present invention, the annular valve seat 26 and the valve section 36 are configured to abut against the mutual inverted conical surfaces 28 and 29, but they may be configured to abut against the erected conical surfaces.

Next, a cap 1*b* according to a second embodiment of the present invention will be described with reference to FIGS. 7 to 10(*b*). When the cap 1*b* according to the second embodiment of the present invention is described, the description will focus on a difference from the cap 1*a* according to the first embodiment of the present invention. The members (portions) identical to or corresponding to those of the cap 1*a* according to the first embodiment will be described using the same reference signs.

Figure 7:
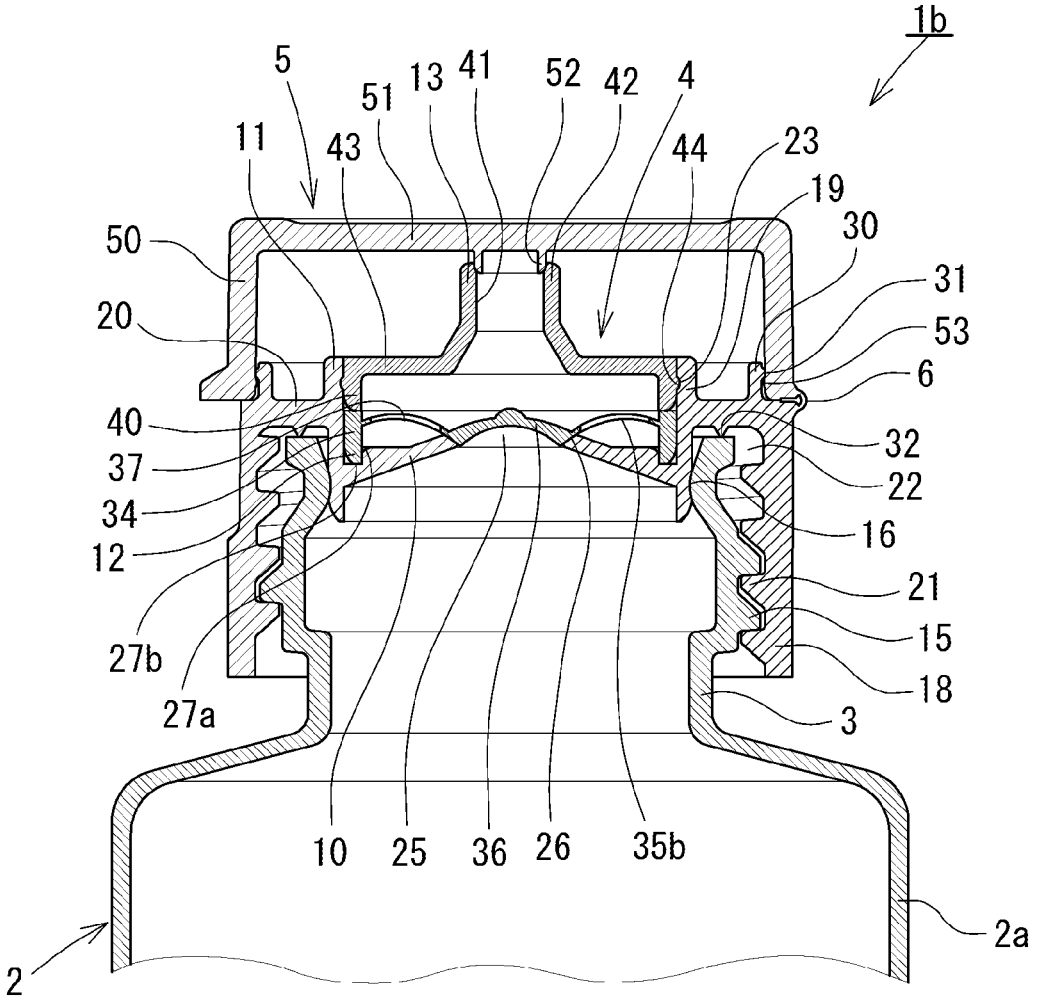
FIG. 7 illustrates a cross-sectional view of a cap according to a second embodiment of the present invention.
Figure 8A:
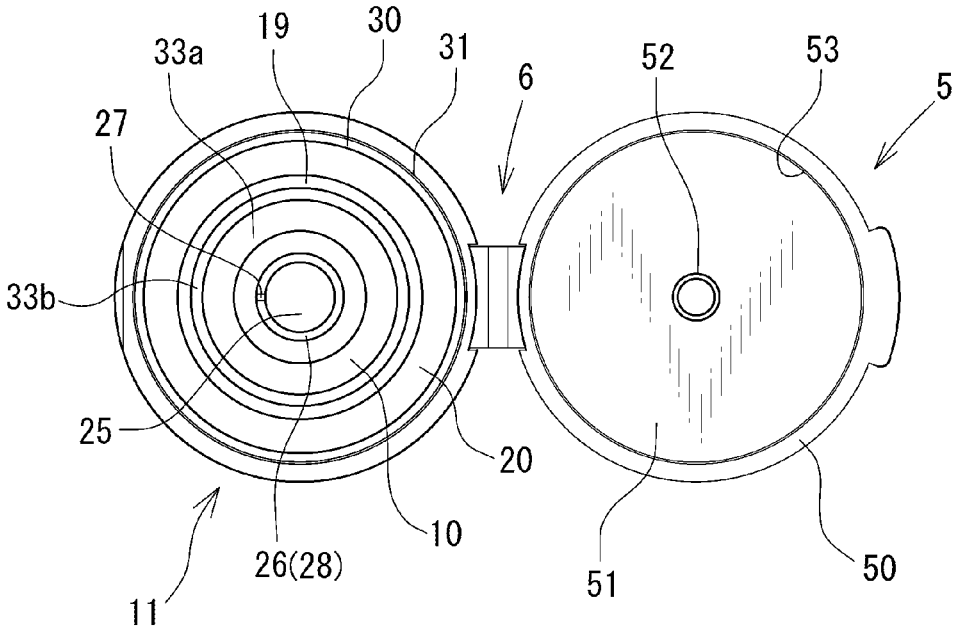
FIG. 8(*a*) illustrates a plan view of a lid and a main cap body including an annular wall section in the configuration of the cap of FIG. 7, and FIG. 8(*b*) illustrates a cross-sectional view of FIG. 8(*a*).
Figure 8B:
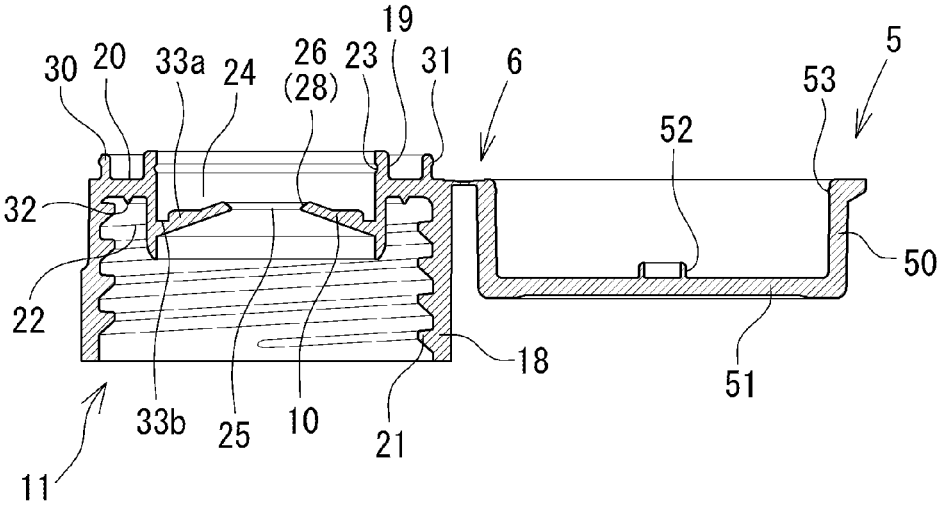

As illustrated in FIGS. 7 to 8(*b*), a main cap body 11 includes: a cylindrical outer wall section 18 screwed to a container mouth section 3; a cylindrical inner wall section 19 concentrically disposed in the inner side of the cylindrical outer wall section 18; and an annular horizontal wall section 20 connecting the upper end of the cylindrical outer wall section 18 and the outer wall surface of the cylindrical inner wall section 19. The cylindrical inner wall section 19 extends vertically to intersect with the annular horizontal wall section 20. An annular space 22 is formed between the cylindrical outer wall section 18 and the cylindrical inner wall section 19 extending downward from the annular horizontal wall section 20.

In the annular horizontal wall section 20, a cylindrical fitting wall section 30 extends upward concentrically on the outer side of the cylindrical inner wall section 19. A protruding locking section 31 extending along a circumferential direction in an annular shape is formed on the upper outer wall surface of the cylindrical fitting wall section 30. A lid 5 is fitted into the outer wall surface of the cylindrical fitting wall section 30. A height of the cylindrical inner wall section 19 positioned upward from the annular horizontal wall section 20 is formed to be slightly higher than a height of the cylindrical fitting wall section 30.

On the lower inner wall surface of the cylindrical inner wall section 19, the annular wall section 10 extends obliquely toward the radial-direction center integrally from the entire circumferential-direction region thereof. However, on an upper surface of a base end portion of the annular wall section 10, an annular protrusion section 33*a* protrudes upward in an interval between the annular protrusion section 33*a* and the inner wall surface of the cylindrical inner wall section 19. In this way, an annular groove section 33*b* is formed between the annular protrusion section 33*a* and the inner wall surface of the cylindrical inner wall section 19. When a check valve 12 to be described below is assembled above the annular wall section 10, a lower end of a cylindrical support section 34 of the check valve 12 is fitted into the annular groove section 33*b*.

Figure 9A:
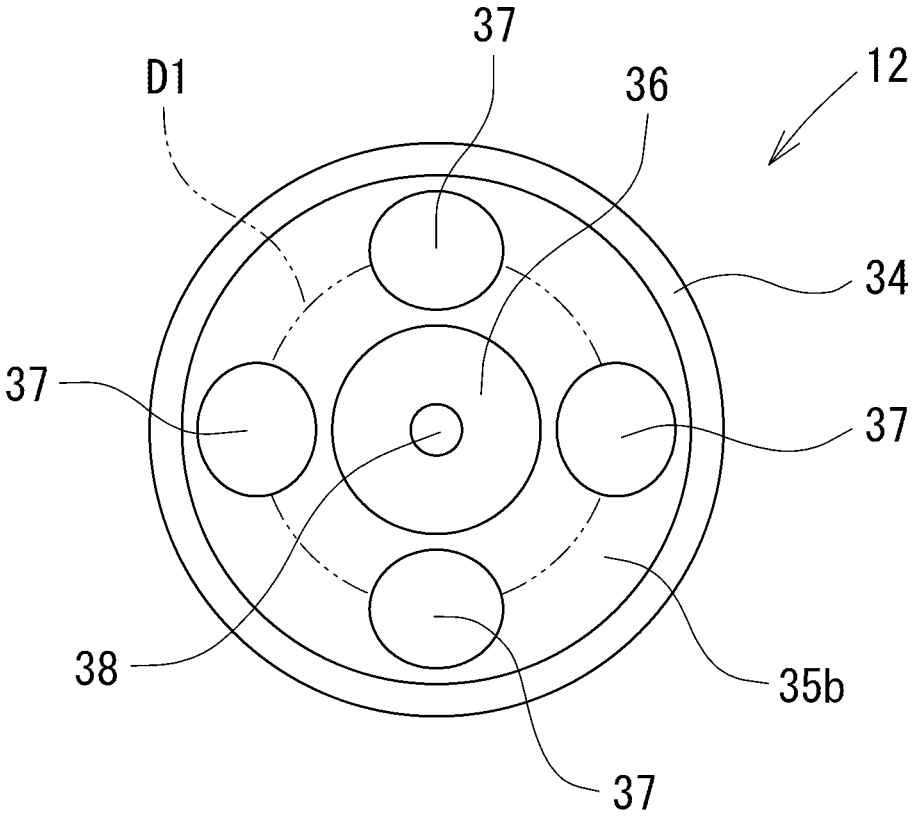
FIG. 9(*a*) illustrates a plan view of a check valve as the configuration of the cap of FIG. 7, and FIG. 9(*b*) illustrates a cross-sectional view of FIG. 9(*a*).
Figure 9B:
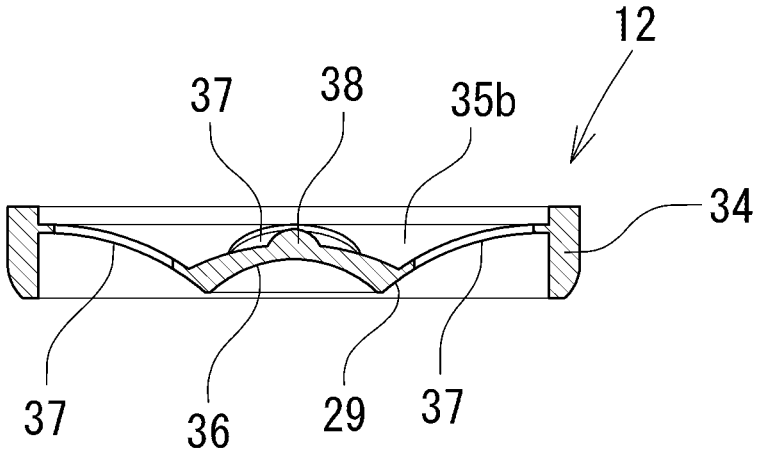

As illustrated in FIGS. 7, 9(*a*), and 9(*b*), the check valve 12 includes: a cylindrical support section 34 abutting against the inner wall surface of the cylindrical inner wall section 19 of the main cap body 11; an annular elastic section 35*b* extending toward a radial-direction center integrally from an entire circumferential-direction region of the inner wall surface of the cylindrical support section 34 and having a downward biasing force; a valve section 36 integrally connected to a radial-direction center portion of the annular elastic section 35*b* to open or close a discharge hole 25; and a plurality of circulation holes 37 disposed between the annular elastic section 35*b* such that the contents from the discharge hole 25 are circulated therethrough.

The cylindrical support section 34 is formed at a height reaching the upper surface of the annular horizontal wall section 20 from the upper surface of the base end portion of the annular wall section 10. The lower end of the cylindrical support section 34 is fitted into the annular groove section 33*b* formed between the annular protrusion section 33*a* provided in the base end portion of the annular wall section 10 and the cylindrical inner wall section 19. The annular elastic section 35*b* extends toward the radial-direction center from the entire circumferential-direction region of the upper inner wall surface of the cylindrical support section 34. The annular elastic section 35*b* extends to be curved toward the radial-direction center and in an obliquely downward direction. A plurality of circulation holes 37 is formed in the annular elastic section 35*b* at regular intervals in a circumferential direction. In the present embodiment, the circulation holes 37 are formed in four places at 90° pitches in the circumferential direction. Each of the circulation holes 37 is formed to have a substantially circular shape, but a slightly oval shape is illustrated in a top view of FIG. 9(*a*). In the present embodiment, each of the circulation holes 37 is formed to have a substantially circular shape, but other shapes, such as a fan shape or an oval shape, may be adopted, and the number thereof also is not limited. Also, instead of the plurality of circulation holes 37, a slit hole of a predetermined width extending in an annular shape may also be adopted.

Since the configuration of the valve body 36 is the same as the configuration of the valve body 36 adopted in the cap 1*a* according to the first embodiment, a description thereof will be omitted herein. In a state (state of FIG. 9(*b*)) before the check valve'12 is assembled as the cap 1*b*, the lower end of the valve section 36 and the lower end of the cylindrical support section 34 are positioned on the substantially same plane. In the present embodiment, in a state before the check valve 12 is assembled as the cap 1*b*, the lower end of the valve section 36 and the lower end of the cylindrical support section 34 are positioned on the same plane. However, in the state of FIG. 7, that is, after the check valve 12 is assembled as the cap 1*b*, the lower end of the valve section 36 and the lower end of the cylindrical support section 34 are not necessarily positioned on the same plane before assembling, as long as the outer peripheral surface of the valve section 36 of the check valve 12 comes into close contact with the annular valve seat 26 around the discharge hole 25 of the annular wall section 10, without gaps, and is pressed by the downward biasing force (restoring force) of the annular elastic section 35*b* itself.

Figure 10A:
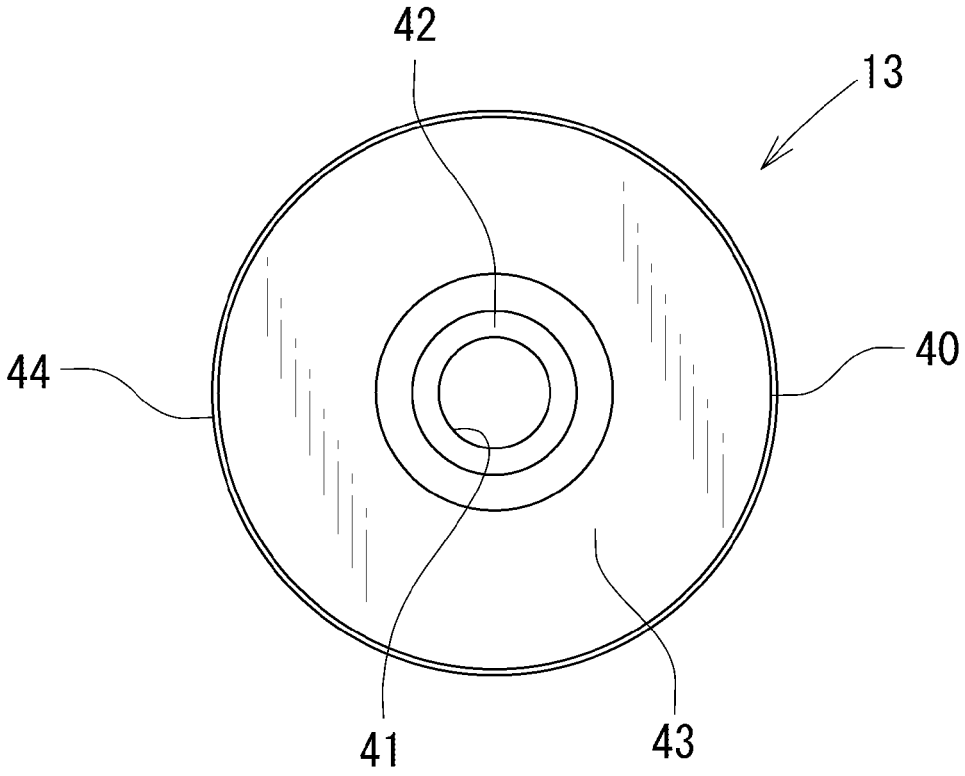
FIG. 10(*a*) illustrates a plan view of a guiding tubular body as the configuration of the cap of FIG. 7, and FIG. 10(*b*) illustrates a cross-sectional view of FIG. 10(*a*).
Figure 10B:
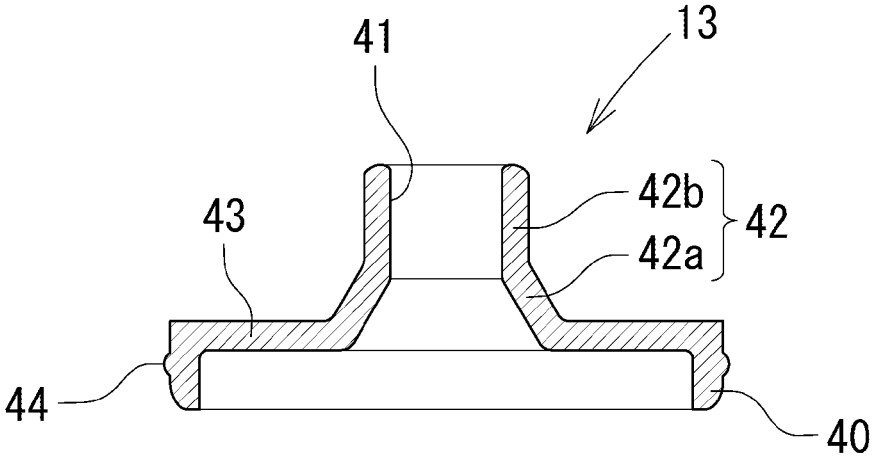

As illustrated in FIGS. 7, 10(*a*), and 10(*b*), the guiding tubular body 13 is disposed above the check valve 12. The guiding tubular body 13 includes: a cylindrical support section 40 fitted into the cylindrical inner wall section 19 of the main cap body 11; a cylindrical guide section 42 disposed concentrically in the inner side of the cylindrical support section 40 and having a discharge passage 41 thereinside; and an annular horizontal wall section 43 integrally connecting the upper end of the cylindrical support section 40 and the lower end of the cylindrical guide section 42. The cylindrical support section 40 has the same height as the cylindrical inner wall section 19 upward from the annular horizontal wall section 20 in the main cap body 11. The cylindrical guide section 42 is configured such that a diameter-enlarged cylindrical section 42*a* which is disposed on the base end portion side and of which the diameter is enlarged toward the base end is integrally connected to a same-diameter cylindrical section 42*b* provided on the front end side. An annular horizontal wall section 43 is integrally connected to the lower end of the diameter-enlarged cylindrical section 42*a*. The inner diameter dimension that is the greatest in the discharge passage 41 of the diameter-enlarged cylindrical section 42*a* substantially coincides with the inner diameter dimension of the discharge hole 25 of the check valve 12.

Next, a method of assembling and mounting the cap 1*b* on the container mouth section 3 according to the second embodiment of the present invention will be described.

First, the check valve 12 is disposed on the upper surface of the annular wall section 10 such that the outer wall surface of the cylindrical support section 34 of the check valve 12 is disposed along the inner wall surface of the cylindrical inner wall section 19 of the main cap body 11. That is, the check valve 12 is incorporated into the space 24 of which the upper side surrounded by the annular wall section 10 and the inner wall surface of the cylindrical inner wall section 19 from above is opened.

Subsequently, the guiding tubular body 13 is incorporated into the upper side of the check valve 12 by pressing, such that the outer wall surface of the cylindrical support section 40 is disposed along the inner wall surface of the cylindrical inner wall section 19 of the main cap body 11. The lower end of the cylindrical support section 34 of the check valve 12 is fitted into the annular groove section 33*b* between the annular protrusion section 33*a* provided in the annular wall section 10 and the cylindrical inner wall section 19. The annular protrusion section 44 provided on the outer wall surface of the cylindrical support section 40 of the guiding tubular body 13 is assembled by fitting into the annular fitting concave section 23 provided on the inner wall surface of the cylindrical inner wall section 19 of the main cap body 11. As a result, the inverted conical surface 29 provided in the outer peripheral portion of the valve section 36 of the check valve 12 is in close contact with the annular valve seat 26 (inverted conical surface 28) around the discharge hole 25 of the annular wall section 10, and the lower wall surface of the valve section 36 and the lower wall surface of the annular wall section 10 are continued to flush with each other. The entire lower wall surface of the valve section 36 faces the inside of the container mouth section 3. Also, since the lower end (outer peripheral portion) of the valve section 36 of the check valve 12 is located at the upper side than the position prior to the incorporation, the inverted conical surface 29 of the valve section 36 of the check valve 12 is closely contacted without gaps and pressed against the annular valve seat 26 (inverted conical surface 28) around the discharge hole 25 of the annular wall section 10 by the downward biasing force (restoring force) of the annular elastic section 35*b*. Also, the cylindrical guide section 42 of the guiding tubular body 13 is disposed directly above the valve section 36 of the check valve 12, and thus, the upper surface of the annular horizontal wall section 43 of the guiding tubular body 13 is matched with the upper surface of the cylindrical inner wall section 19 of the main cap body 11. In this way, the assembling of the cap body 4 is completed.

Subsequently, when the lid 5 is covered on the cap body 4, the hinge 6 is bent to cover the lid 5 from above the cap body 4. Then, the protruding locking section 53 provided in the body section 50 of the lid 5 is engaged to climb over the protruding locking section 31 provided in the cylindrical fitting wall section 30 of the cap body 4. The cylindrical close contact section 52 provided in the top surface section 51 of the lid 5 is tightly fitted into the upper end inner portion of the same-diameter cylindrical section 42*b* of the cylindrical guide section 42 constituting the guiding tubular body 13 of the cap body 4.

Subsequently, when the cap body 4 is mounted on the container mouth section 3, the male screw section 15 provided on the outer wall surface of the container mouth section 3 and the female screw section 21 provided on the inner wall surface of the cylindrical outer wall section 18 of the cap body 4 are screwed to each other by inserting the peripheral wall portion of the container mouth section 3 into the annular space 22 between the cylindrical inner wall section 19 and the cylindrical outer wall section 18 of the cap body 4. In this way, the outer wall surface of the cylindrical inner wall section 19 of the main cap body 11 is crimped by the fitting wall section 16 of the container mouth section 3, and furthermore, the lower end of the annular sealing section 32 vertically provided from the lower surface of the annular horizontal wall section 20 of the main cap body 11 comes into close contact with the upper end of the container mouth section 3. In this way, the mounting of the cap 1*b* on the container mouth section 3 is completed.

Next, the operation of the cap 1*b* according to the second embodiment of the present invention will be described.

When the contents are used, first, the lid 5 is opened to expose the guiding tubular body 13 of the cap body 4 to the outside.

Subsequently, the user applies the internal pressure to the container 2 by squeezing the body section 2*a* of the container 2. In this way, the internal pressure of the container 2 acts on the entire lower wall surface of the valve section 36 of the check valve 12, and the annular elastic section 35*b* of the check valve 12 is elastically deformed to be bent upward from the boundary of the wall section (wall section (dashed-two dotted line) indicated by D1 of FIG. 9(*a*)) of which the distance from the base section or the adjacent circulation hole 37 is shortest. The inverted conical surface 29 of the outer peripheral portion of the valve section 36 is detached from the annular valve seat 26 (inverted conical surface 28) around the discharge hole 25 of the annular wall section 10. As a result, the discharge hole 25 of the annular wall section 10 is opened, and an appropriate amount of the contents are collected from the container mouth section 3 to the discharge hole 25 along the truncated conical lower wall surface of the annular wall section 10. The contents are discharged from the discharge hole 25 to the outside through the respective circulation holes 37 of the annular wall section 10 and the discharge passage 41 of the cylindrical guide section 42 of the guiding tubular body 13. At this time, since the internal pressure of the container 2 acts on the entire lower wall surface of the valve section 36 of the check valve 12, the valve section 36 of the check valve 12 is smoothly moved upward to open the discharge hole 25. Furthermore, the annular wall section 10 of the cap body 4 extends obliquely in an upward direction toward the radial-direction center from the inner wall surface of the cylindrical inner wall section 19. Therefore, the contents can easily flow in a direction of the discharge hole 25 along the truncated-conical lower wall surface of the annular wall section 10.

Then, after the contents are used, if the squeezing of the body section 2*a* of the container 2 is stopped, the internal pressure to the container 2 is released. Therefore, the annular elastic section 35*b* of the check valve 12 is restored, and the valve section 36 is seated on the annular valve seat 26 around the discharge hole 25 of the annular wall section 10. The discharge hole 25 of the annular wall section 10 is closed by the valve section 36. At this time, the valve section 36 of the check valve 12 is biased to press the annular valve seat 26 by the biasing force of the annular elastic section 35*b*. In this way, immediately after use, the user can quickly seal the container 2 and suppress air from flowing into the container 2, without operating the cap 1*b* by hand. When the internal pressure to the container 2 is released, the contents that are not discharged from the discharge passage 41 of the guiding tubular body 13 to the outside (contents between the guiding tubular body 13, and the check valve 12 and the annular wall section 10) are returned to the container 2 through the circulation groove 27 formed on the inverted conical surface 28 of the annular valve seat 26. This operation is the same as the operation of the cap 1*a* according to the first embodiment.

Subsequently, if the hinge 6 is bent to cover the lid 5 from above the cap body 4, the protruding locking section 53 provided in the body section 50 of the lid 5 is engaged to climb over the protruding locking section 31 provided in the cylindrical fitting wall section 30 of the cap body 4. The cylindrical close contact section 52 provided in the top surface section 51 of the lid 5 is tightly fitted into the upper end inner portion of the same-diameter cylindrical section 42*b* of cylindrical guide section 42 constituting the guiding tubular body 13 of the cap body 4.

The cap 1*b* according to the second embodiment can obtain the same effect as the cap 1*a* according to the first embodiment.

REFERENCE SIGNS LIST

1*a*, 1*b* cap, 2 container, 3 container mouth section, 4 cap body, 5 lid, 6 hinge, 10 annular wall section, 11 main cap body, 12 check valve, 13 guiding tubular body, 19 cylindrical inner wall section (cylindrical wall section), 24 space, 25 discharge hole, 26 annular valve seat, 27 circulation groove, 28, 29 inverted conical surface, 34 cylindrical support section, 35*a* elastic piece, 35*b* annular elastic section, 36 valve section, 37 circulation hole, 41 discharge passage.

The invention claimed is:

1. A cap, which comprises a cap body to be fitted into a container mouth section and is made of a synthetic resin, wherein the cap body includes a cylindrical wall section to be fitted into an inner wall surface of the container mouth section, an annular wall section that (i) extends obliquely in an upper direction toward a radial-direction center, integrally from an inner wall surface of the cylindrical wall section, (ii) has a lower wall surface of a truncated conical shape, and (iii) has a discharge hole in a radial-direction center portion, an elastic check valve disposed above the annular wall section the check valve having a valve section configured as a curved wall section with an upwardly convex shape making a dome configuration, the valve section having an inverted conical surface on its most outer surface, an annular valve seat having an inverted conical surface formed on an inner wall surface of the discharge hole allowing the whole inverted conical surface of the valve section to be detached from or seated on the inverted conical surface of the annular valve seat so as to open and close the discharge hole, and a guiding tubular body disposed above the check valve and having a discharge passage of contents from the discharge hole, wherein a lower end edge of the annular valve seat and a lower end edge of an outer circumferential surface of the valve section are both configured to be positionally correspondent with each other when the outer circumferential surface of the valve section is seated on the annular valve seat.

2. The cap according to claim 1, wherein the cap body is configured by arranging the check valve in a space where an upper side constituted by the cylindrical wall section and the annular wall section is opened, and is configured by arranging the guiding tubular body onto the check valve.

3. The cap according to claim 1, wherein the check valve includes a cylindrical support section that abuts against the inner wall surface of the cylindrical wall section, an annular elastic section that extends toward a radial-direction center integrally from an entire circumferential-direction region of the inner wall surface of the cylindrical support section, the valve section integrally provided in a radial-direction center portion of the annular elastic section to open or close the discharge hole, and a circulation hole disposed in the annular elastic section such that the contents from the discharge hole are circulated therethrough, and wherein an outer peripheral portion of the valve section is pressed against the annular valve seat by the biasing force of the annular elastic section.

4. A cap, which comprises a cap body to be fitted into a container mouth section and is made of a synthetic resin, wherein the cap body includes a discharge hole that communicates with the container mouth section, an annular valve seat provided around the discharge hole, and a check valve that opens or closes the discharge hole in such a manner that an outer circumferential surface of a valve section is detached from or seated on the annular valve seat, wherein each outer circumferential surface of both the annular valve seat and the valve section abuts against their mutual inverted conical surfaces, and a circulation groove is formed on the annular valve seat, the circulation groove being configured to extend through an entire radial dimension of the annular valve seat in a radial direction so as to allow contents to pass therethrough, the check valve is made from synthetic resin that has elasticity higher than the annular valve seat, the circulation groove is defined to have two side walls facing to each other and a bottom wall connecting the two side walls so as to be U-shape in section, and each of the two faced side walls of the circulation groove is configured to come closer as moving down toward the bottom wall, and in a condition where the cap is installed to the container mouth section, at an initial stage that the outer circumferential surface of the value section is seated on the annular valve seat after using the contents in a container, an opening defined between the circulation groove and the outer circumferential surface of the valve section is configured to be sustained, and the opening is closed after a lapse of time.

5. The cap according to claim 4, wherein the circulation groove is formed to have a width dimension of 0.2 mm to 3.0 mm and a depth dimension of 0.02 mm to 0.06 mm.

* * * * *